United States Patent [19]

Kuo

[11] 4,423,688

[45] Jan. 3, 1984

[54] BRUSH FEEDER FOR DISPOSAL OF THERMOPLASTIC WASTE IN A FLUIDIZED BED REACTOR

[75] Inventor: Hong-Hsiang Kuo, Troy, Mich.

[73] Assignee: General Motors Corporation, Detroit, Mich.

[21] Appl. No.: 370,456

[22] Filed: Apr. 21, 1982

[51] Int. Cl.[3] ..... F23G 5/00

[52] U.S. Cl. ..... 110/245; 110/110; 110/346; 198/659

[58] Field of Search ..... 110/110, 245, 346; 414/310, 311, 312, 321; 198/659

[56] References Cited

U.S. PATENT DOCUMENTS

| | | | |
|---|---|---|---|
| 1,255,275 | 2/1918 | Barnett et al. | 198/659 |
| 3,121,501 | 2/1964 | Laidig | 414/312 |
| 3,472,185 | 10/1969 | Burden, Jr. | 110/110 X |
| 4,308,806 | 1/1982 | Uemura et al. | 110/244 |

FOREIGN PATENT DOCUMENTS

| | | | |
|---|---|---|---|
| 1027506 | 7/1978 | Canada | 198/659 |
| 2724071 | 5/1977 | Fed. Rep. of Germany | 198/659 |

*Primary Examiner*—Edward G. Favors
*Attorney, Agent, or Firm*—Elizabeth F. Harasek

[57] ABSTRACT

In accordance with the invention, a means and method are provided for continuously delivering thermoplastic particles to an operating fluidized bed reactor in which they are thermally degraded. Conveyor systems of the type used to feed non-meltable feedstocks to fluidized bed reactors were found to be unsuitable for the application. Accordingly, a novel device was developed in which polymer particles are conveyed to a reactor in a specialized feed tube. The tube features a brush-screw auger-type feeder and a source of pressurized gas to agitate the particles therein and prevent backflow of hot reactor fluids.

3 Claims, 6 Drawing Figures

BRUSH FEEDER FOR DISPOSAL OF THERMOPLASTIC WASTE IN A FLUIDIZED BED REACTOR

This invention relates to a novel means and method for charging thermoplastic waste materials into a fluidized bed reactor operating at a temperature substantially above the melting temperature of the waste.

BACKGROUND

Heretofore, non-reclaimable thermoplastic polymeric scrap materials have, for the most part, been disposed of as land fill. As the availability of land fill sites diminishes, the cost of plastic waste disposal in this manner increases.

Polymer waste is generated in many ways. For example, a great amount of thermoplastic paint sludge is collected from paint spray booths. Overspray is first flocculated in a water cascade and then collected as sludge. The sludge is dried and disposed of in sealed containers. Other sources of polymer waste are pure or highly filled thermoplastic injection or compression molded compositions. Molding materials with both thermoplastic and thermosetting constituents are common because such materials cannot be readily reprocessed.

It is well known that most polymers can be burned, and that the burning reaction produces a substantial amount of heat energy. Thus, incineration has been considered as an alternative to solid waste disposal. Incinerating thermoplastics, however, presents a number of serious problems. For example, in conventional incinerators, thermoplastic polymers have a tendency to melt. The molten material inhibits uniform combustion which may cause excess smoke production and incomplete incineration. Moreover, thermoplastic waste materials have a wide range of heating values. For example, a paint sludge having a high heating value might produce elevated temperatures that could damage a conventional incinerator. If the heating value of a paint sludge is low, the sludge may not burn continuously or completely.

In my search for alternative methods of burning polymer scrap, consideration was given to the use of fluidized bed incinerators. However, conventional fluidized bed incinerators used to burn coal, paper, wood and other such materials are not suitable for incinerating all polymers, particularly thermoplastics. Thermoplastics melt and clog the fluidized bed. Moreover, conventional continuous conveyor type feeding systems for coal and other nonmeltable fuels are not adaptable to feeding meltable plastic scrap materials. Either the plastic melts and clogs the feeder mechanism before it reaches the reactor or the individual particles agglomerate so badly in the feeder that they cannot be absorbed into the fluidized bed. Batch type feeding is impractical. If too much cold scrap is added at one time, it can quench the burning reaction. Adding small amounts to the top of a fluidized bed is inefficient and/or impractical due to heat loss, escape of reaction products and inability of the bed to integrate the waste.

By way of definition, the term pyrolysis herein refers to the degradation of polymeric materials at elevated temperatures in an oxygen deficient atmosphere. The terms incineration and burning refer to the thermal degradation reaction of polymers in the presence of enough oxygen to support combustion of burnable constituents at suitable elevated temperatures.

OBJECTS

Accordingly, it is an object of the invention to provide a method and apparatus for processing thermoplastic waste material in a fluidized bed reactor for purposes such as reducing its bulk or recovering heat energy. A more particular object is to provide a method and means for feeding thermoplastic scrap into a fluidized bed reactor in which the scrap is pyrolyzed or incinerated.

Another object is to continuously transport meltable polymeric particles from a remote source thereof into a fluidized bed reactor operating at a temperature much higher than the polymer melting temperature. More specifically, it is an object to deliver such polymer particles into such reactor without any appreciable melting, fusion, or agglomeration in the feeding apparatus. It is a more specific object to employ feed tube means which open directly into an operating fluidized bed reactor. The tube is provided with a specially adapted screw-type feeder and a pressurized source of gaseous coolant to assist the transport of particles.

BRIEF SUMMARY

These and other objects may be accomplished as follows. In a preferred practice of the invention, a polymer containing waste material such as dried paint sludge is continuously delivered to a fluidized bed reactor in particulate form. The reactor comprises a chamber in which a bed of inert refractory particles is continuously agitated by hot gases admitted through the bottom of the reactor to form a fluidized bed. The bed is initially heated to a temperature above the degradation temperature of the polymer particles.

In order to continuously and efficiently operate the fluidized bed reactor, means must be provided to deliver a stream of polymeric waste particles into the bed as needed. This presents considerable problems, particularly when the waste is made up at least in part of thermoplastics which tend to melt and clog both feeder and reactor. The particles may fuse together due to mechanical mastication or by heating to a temperature where the plastic at the particle surfaces becomes tacky. The temperature at which a polymer particle becomes soft and tacky enough to fuse with other particles is referred to herein as the fusion temperature.

In accordance with a preferred practice of the invention, waste is introduced into a hot reactor by means of a feed tube which extends from a remote source of particles, through the reactor walls and into or immediately adjacent the fluidized bed. A source of pressurized gas such as air or nitrogen is provided near the particle source. The gas is caused to flow from the source through the tube toward the reactor to maintain the temperature therein above the melting temperature of the particles. The flow of the relatively cool gas prevents the polymer particles from fusing together. It also serves to agitate the the particles as they travel through the tube so they do not stick to the tube walls or feeder screw. The rate of flow of the gas is controlled to prevent any back-up of hot gases or particles from the fluidized bed into the open outlet end of the feed tube.

In conjunction with the gas source, a specially adapted feeder screw is employed. Conventional auger screws are not suitable for delivering polymer scrap because they tend to masticate and thereby aggregate the particles. In the subject auger-type feed screw, flexible stainless steel bristles comprise the radial screw flights. The bristles are carried on a shaft which rotates in the feed tube. Shaft rotation carries the particles from the source thereof to the fluidized bed. If too much resistance builds up in the barrel, the bristles merely flex out of the way. This prevents damage to the feed tube walls. The bristles further act to break up aggregates of particles.

Thus, the provision of a source of pressurized gas and a brush screw auger-type feeder for a suitable feed tube provide means to continuously feed polymeric waste into an operating fluidized bed reactor.

Once disposed in the fluidized bed, the polymer particles aggregate with the refractory particles. The flow of fluidizing gas is regulated to assure that the aggregate particles are suspended and agitated within the bed. At the elevated operating temperature of the reactor, any polymer therein thermally degrades either by pyrolysis (in the absence of oxygen) or incineration (in the presence of oxygen). The pyrolysis reaction is endothermic and may yield reaction products (such as free monomer) that can be collected and recycled. Incineration, on the other hand, is exothermic and releases substantial amounts of heat energy. Because of the agitation of the bed, this heat is evenly redistributed providing enough energy to raise the temperature of added polymeric particles. Excess heat energy is preferably recovered by heat exchanging means disposed within the reactor. This recovered heat may be used, as desired, for such purposes as heating water or drying raw paint sludge.

The rates of introduction of polymer waste and oxygen during incineration and the removal of heat are regulated to operate the reactor under substantially steady state conditions.

The reaction products of pyrolyzed and burned polymers generally consist of hot gases and small particulates. These may be collected by such conventional means as electronic precipitation, cyclone separation and spray condensation.

I have found that delivering highly pigmented automotive acrylic paint sludge to a fluidized bed reactor in accordance with the invention and burning it therein reduces its bulk by approximately 10:1 and generates approximately 2500 kilo-calories of heat per pound of dry sludge. Much of the residue is noncombustible pigment recovered primarily in the form of metal oxides. Accordingly, the disposal of polymeric waste by the practice of my invention realizes substantial cost savings over solid waste disposal and also generates useful heat energy or recyclable byproducts.

DETAILED DESCRIPTION

My invention will be better understood in view of the Figures and detailed description which follows.

In a preferred practice of the invention, waste material made up at least in part of a meltable thermoplastic polymer is processed in a fluidized bed reactor to reduce its bulk and recover heat energy. While the subject feed mechanism for the reactor is specifically directed toward processing polymers which would otherwise melt and clog conventional feeders and fluidized bed reactors, the subject apparatus could be used to process other more easily handled materials such as thermosetting polymers, natural organic matter or carbon based fuels.

The subject feeder means is particularly adapted to processing paint sludge in a fluidized bed reactor. Paint sludge is the residue formed by the agglomeration of water or solvent based paint overspray in cascade spray booths. The sludge is generally saturated with water as formed, but is dehydrated, compressed and crushed to particles of varying sizes before its introduction into the subject fluidized bed reactors. I have found that the use of powdered sludge (less than 2 mm particle diameter) alone may cause too rapid an exothermic reaction. On the other hand, when all larger sized particles are introduced (greater than 5 mm particle diameter), the induction time to a self-sustaining reaction may take several minutes. Use of paint sludge crushed to yield a cross section of particle sizes in the range from about 1 mm to 10 mm provides for smooth and instantaneous burning in a suitable fluidized bed reactor. Accordingly, it is preferred to prepare thermoplastic waste by comminuting it to particles of mixed sizes prior to burning or pyrolysis in accordance with the method and means claimed herein. The maxium desirable particle size would be a function of the size and operating parameters of the reactor used, and would be readily determinable by one skilled in the art.

Automotive paint finishes are generally comprised, at least in part, of thermoplastic acrylic resin. Acrylic resins may be thermally degraded by two reaction mechanisms. First, they may be heated to a high temperature in the absence of oxygen. This process causes pyrolysis of the polymer. In pyrolysis, the polymerized acrylates are broken up yielding a substantial portion of methyl-methacrylate monomer, other short chain carbon constituents and heat. The other relevant reaction mechanism for acrylate degradation is combustion in the presence of oxygen, also referred to herein as incineration or burning. It is believed that in the subject burning process, pyrolysis first takes place and thereafter the pyrolysis products burn with oxygen to yield reaction products including carbon dioxide, water and heat.

Figure 1:
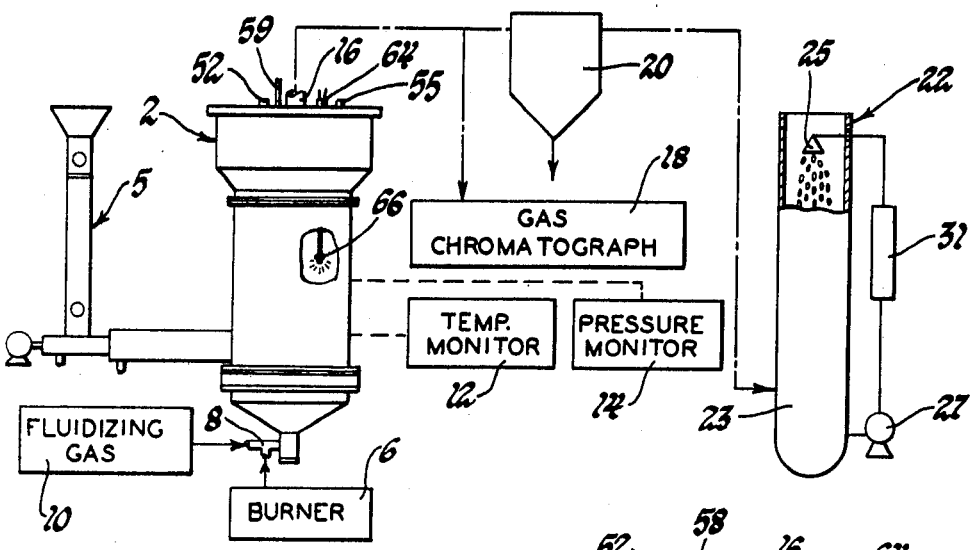
FIG. 1 is a schematic diagram of a fluidized bed reactor system for pyrolyzing or burning particulate thermoplastic materials.

FIG. 1 is a schematic representation of a system particularly adapted for pyrolyzing or burning ground thermoplastic acrylic paint sludge, one of the most difficult polymer waste disposal problems. At the heart of the system is a fluidized bed reactor 2 which is shown in greater detail at FIG. 2. Particulate thermoplastic waste is introduced at a location near the bottom of the reactor by means of a feed mechanism 5 in accordance with the invention shown in greater detail at FIG. 5.

Prior to introducing thermoplastic waste particles into reactor 2, reaction chamber 4 (FIG. 2) and particle bed 7 are heated to a temperature sufficient to initiate the desired degradation reaction. Heating is initially accomplished by means of gas burner 6. Hot gases from burner 6 are directed through a branched pipe fitting 8 near the bottom of reactor 2. A pressurized source 10 of a fluidizing gas is also provided. The fluidizing gas is also admitted through fitting 8, as necessary, to cause agitation and fluidization of the particle bed 7 within reactor 2. Bed 7 is shown at rest in FIG. 2. Temperature monitor 12 and pressure monitor 14 are connected to several probes in the reactor walls. The monitors are provided to closely monitor conditions within reaction chamber 4 so that operating conditions may be controlled to achieve peak efficiency.

The degradation reaction of thermoplastic waste in reactor 2 generally produces particulate and gaseous products. Some solid waste products are retained and carried in the fluidized bed during its operation. These are removed from the bottom of the reactor after a run. Gaseous products and fine particulates are continuously exhausted through an exit port 16 located at the top of reactor 2 while it operates. The composition of these products is determined by means of gas chromatograph 18 which analyzes samples intermittently withdrawn from reactor exhaust. Particulates are collected in cyclone separator 20. Very fine particulates and vapors are collected downstream of separator 20 in spray condenser 22.

Figure 2:
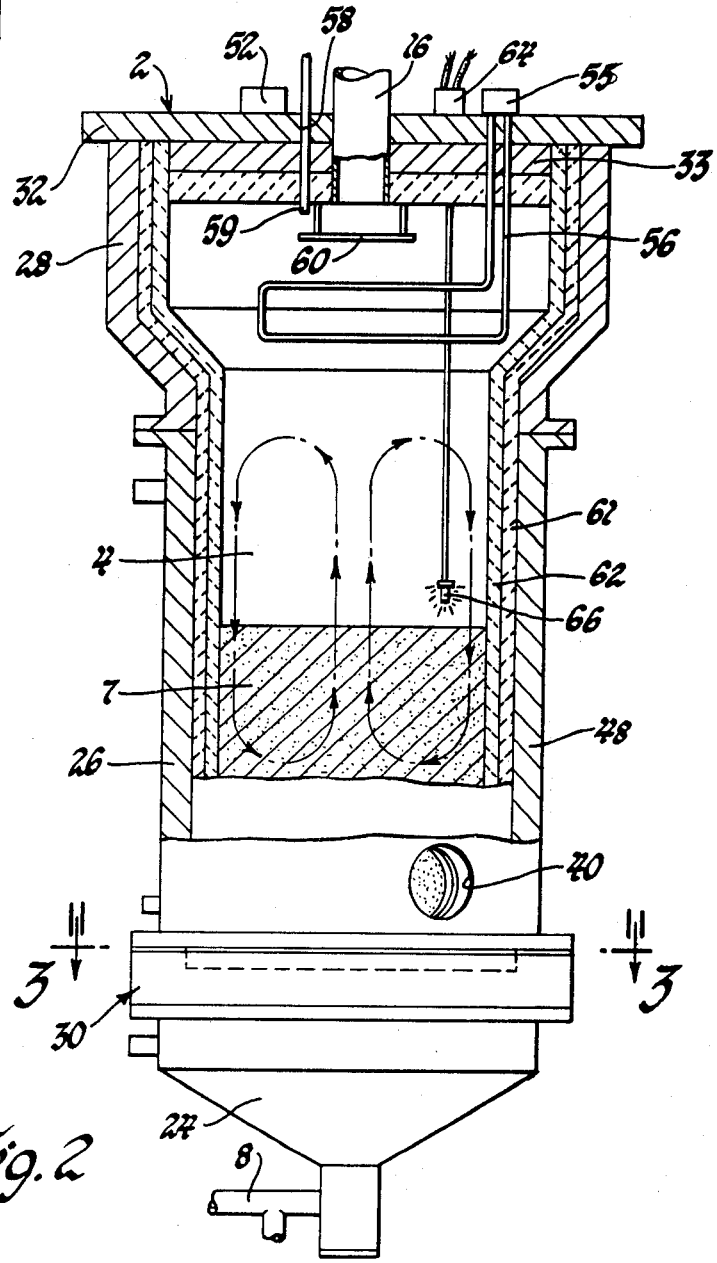
FIG. 2 is a sectional view of a fluidized bed reactor of the type suitable for the practice of the invention.

Referring now to FIG. 2, a reactor 2 in which paint sludge was burned as described and claimed herein is schematically shown in some detail. Reactor 2 is made up of three stacked sections: a plenum or wind box 24 at the bottom, reaction chamber housing 26 above plenum 24, and flue 28 above housing 26. A gas distributor or diffuser plate 30 is interposed between plenum 24 and housing 26, and cover 32 overlays flue section 28. The sections are secured together by means of bolts and gasket materials (not shown) to form airtight seals between the members.

Fluid flow in reactor 2 is generally upwards from bottom to top. Fluidizing and heating gases are introduced through fitting 8, distributed evenly through plenum 24 and then forced through distributor plate 30 into reaction chamber 4. Plenum 24 is shaped like an inverted funnel, opening up towards gas distributor plate 30. The flow rate of the gas through plate 30 is regulated to control the fluidization of bed 7.

Generally, 10 kilograms of 80 mesh white silica sand was introduced into chamber 4 to form particle bed 7 before each run. While sand is a preferred bed agent, other materials which would not interfere with the polymer degradation would also be suitable. For example, crushed limestone or even particles catalytic to the reaction could be used.

Figure 3:
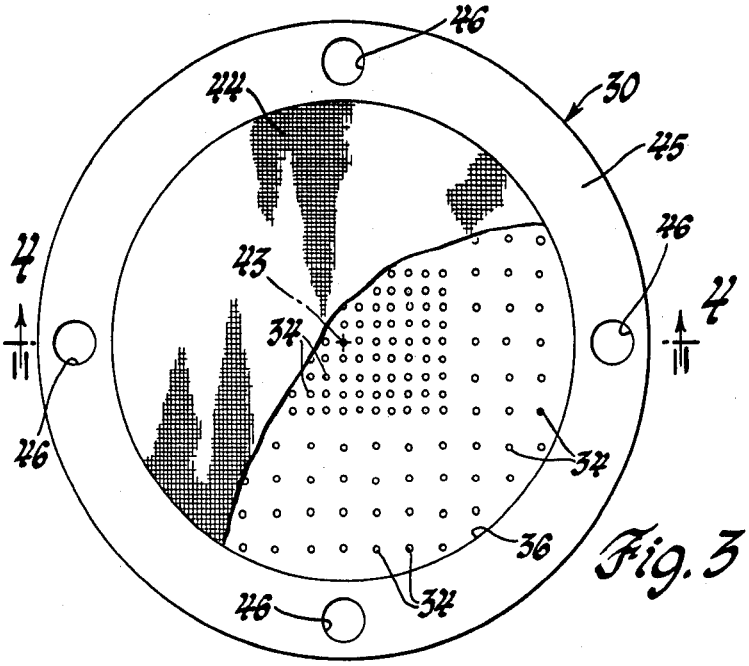
FIG. 3 is a broken away plan view of a distributor plate and screen through which pressurized gas is admitted into a fluidized bed reaction chamber.
Figure 4:
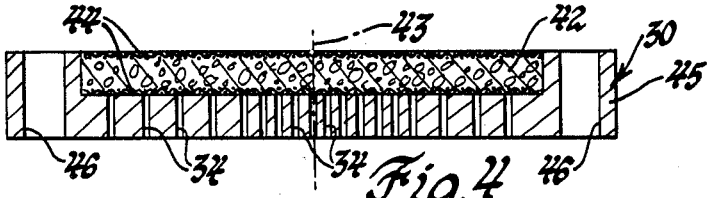
FIG. 4 is a sectional side view of the distributor plate and screen of FIG. 3.

Referring now to FIGS. 3 and 4, distributor plate 30, machined from 310 stainless steel, is 350 mm in diameter, 10.8 mm thick at the center 43 and 15.9 mm thick at flange 45. Holes 34 are provided in plate 30 to distribute air from plenum 24 into reaction chamber 4. Eight hundred and eighty one (881) holes, 1.5 mm in diameter each, were drilled through plate 30 in a pattern like that shown generally at FIG. 3. Substantially more holes 34 were drilled near the center 43 of plate 30 than near flange 45. Bolt holes 46 are provided in flange 45 for fastening housing 26, plate 30 and plenum 24 together.

Fluidization of refractory particle bed 7 in chamber 4 is caused by the flow of gas through holes 34. The arrangement of holes determines the path of particle flow in reaction chamber 4. The array of holes 34 in plate 30 of FIGS. 3 and 4 causes the particles to travel in a toroidal path from along the bottom of the bed towards the center, up the center of the toroid, across the top and then down the wall of the reactor back towards the bottom as indicated with broken lines at FIG. 2. Because of the cyclical motion of the particles of bed 7, when thermoplastic feed stock is introduced through inlet 40 in the reactor housing section 26, it is immediately carried to the bottom. Thereafter, the feed stock joins the toroidal flow path of the refractory particles. Thus, the use of a distributor plate as described assures that waste particles can be introduced into a fluidized bed reactor without creating localized cold spots which tend to melt the thermoplastic without substantial instantaneous degradation. The presence of cold spots can quench the degradation reaction and cause clogging of the reactor.

Again, referring to FIG. 4, a disc 42 of metallic foam (80% Co, 10% Ni, 10% Cr alloy) is disposed in a circular groove in the top of distributor plate 30. Foam disc 42 mediates the flow of pressurized gas through holes 34 without affecting the flow path of particles in the fluidized bed. It also acts as a fail safe to prevent any fugitive melted plastic or particulate of bed 7 from clogging holes 34. Because this metal foam is fragile, it is sandwiched between two layers 44 of fine mesh stainless steel wire cloth.

Referring again to FIG. 2, outer wall 48 of chamber section 26 is a tubular stainless steel structure having a right circular cylindrical shape. The chamber is 533 mm high with an outside diameter of 280 mm and an inside diameter of 203 mm. Six heating coils (not shown) are provided around outer wall 48 for initially elevating its temperature to prevent substantial heat loss from reaction chamber 4. During operation, the fluidized bed is substantially confined to reactor section 26.

Flue section 28 has an outer wall 29 made of stainless steel which is positioned above reaction chamber section 26. It tapers outwardly from the size of housing 26 to a larger outside diameter of 432 mm. Flue 28 is 300 mm high. On the top of flue section 28, a 13 mm thick cover plate 32 is provided with a positioning insert disc 33 and insulating layer 35.

Cover 32 has several ports therethrough, the largest of these (in diameter) is located in the center as an outlet 16 for gaseous and fine particulate reaction products. Covered access door 52 was provided for introducing particles to refractory bed 7. A sealed portal 55 was provided for accommodating heat exchanger 56. A small port 58 was provided for gas sampling line 59 to the gas chromatograph.

Sealed port 64 was provided for electrical connections 63 to glow plug 66. Glow plug 66 was situated inside the reactor 4 a few centimeters above static bed 7. Glow plugs are well known for use in localized heating applications. See, for example, U.S. Pat. No. 4,112,577 assigned to the assignee hereof. Glow plugs are generally known in the electrical heater art to comprise a closed end tubular protective metal ignition source, any other ignition source which can be operated at a temperature above the combustion temperature of the material to be burned in the reactor would be suitable.

The point ignition source (glow plug 66) operates to continuously ignite at least the portion of scrap material adjacent to it. This ignited material is then rapidly carried throughout the reactor by the action of the fluidized bed.

Thus, inclusion of a point ignition source serves to prevent the accumulation of combustible and potentially explosive gases in the reactor. It further serves to prevent auto-extinction of a burning reaction, particularly if the reactor temperature is allowed to fall to a temperature close to the minimum temperature at which the burning reaction is self-sustaining. The ignition source also initiates the polymer burning reaction in a fluidized bed reactor at a temperature substantially lower than the auto-ignition temperature of the polymer constituents therein.

A baffle 60 is disposed beneath outlet 16 of flue 28 to prevent the passage of large particles from the reactor. Housing 26 and flue 28 are lined with 25 mm thick layer 62 of cast and dried refractory. A refractory blanket 61 was inserted between housing outer wall 48, flue wall 29 and refractory line 62 for further insulation value. Obviously, the amount of heat recoverable from exothermic burning of polymers is a function of heat loss from the reactor. Therefore, improved insulation can improve heat recovery.

The temperature of the fluidized bed reactor and heated sampling line were measured with Chromel-Alumel thermocouples. The temperatures were displayed on a 0°-2000° F. range Leads and Northrup digital readout thermometer. Thermocouple ports (not shown) were provided in the reactor walls at vertical separation distances of about 150 mm.

Figure 5:
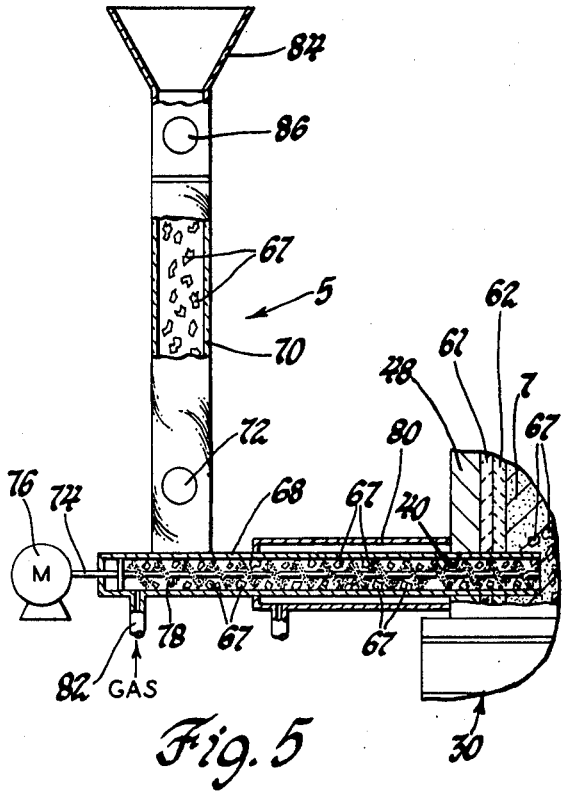
FIG. 5 is a sectional view of a brush screw feeder in accordance with this invention for introducing thermoplastic materials into an operating fluidized bed reactor.

This invention relates particularly to a method and means for feeding polymeric waste particles to the fluidized bed reactor described above. A preferred embodiment of such feeder means is shown at FIG. 5. It was designed particularly for transporting dried, ground, thermoplastic paint sludge particles having an average size less than about 10 mm.

Feeder tube 68 was made of tubular stainless steel. It was approximately 30 cm long, and about 75 mm in diameter. Tube 68 extended a distance of about 25 mm into reactor chamber 4 through inlet 40. This was done so that the feeder would empty the particles into the fluidized bed where they would be immediately absorbed. Tube 68 was hermetically sealed with respect to reactor housing 48 at 69 to prevent any leakage of hot or noxious constituents from the reactor.

Cold water jacket 80 was provided around tube 68 as a supplemental means of maintaining the tube and the material within it at a temperature below the melting temperature of the paint sludge.

Prior to delivery to feed tube 68, sludge particles 67 were stored in hopper 70. The hopper was made of clear acrylic polymer so that the flow of material therethrough could be visually monitored. Hopper 70 was approximately 80 cm high and 75 mm in diameter. Particles 67 were poured into chute 84 with valve 86 open and valve 72 closed. Clearly, it is not critical to the invention how the particles are stored prior to introduction to feed tube 68. The hopper shown here was found to be convenient for the experimental runs made with reactor 2.

In order to convey particles from hopper 70 to reactor chamber 4, valve 72 was opened and valve 86 was closed. This isolated the feeder mechanism from the outside. Pressurized air was introduced through gas inlet 82 located at the end of feed barrel 68. The air was admitted at a rate to keep the particles 67 mobile and unmelted while in feed tube 68. The air pressure in the feed tube must be greater than reactor pressure to prevent backflow of hot reactor gases. If the particles are to be degraded by hydrolysis, it is preferable to use an inert carrier gas such as nitrogen in feed tube 68. The cooling action of the water jacket 80 and pressurized gas work together to further prevent any sticking or melting of particles 67.

Transportation of particles 67 from inlet 71 to feeder tube 68 was principally accomplished by the cooperative auger action of feeder brush 73 and the agitative gases admitted at inlet 82. The brush feeder comprised a straight shaft 74 on which a plurality of helically oriented stainless steel wire bristles 78 were mounted. Shaft 74 was sealably journaled through end wall 75 of feed tube 68 and baffle 77. Feeder brush 73 was operated by driving shaft 74 with motor 76. From the perspective of FIG. 5, clockwise rotation of brush feeder 73 causes particles 67 to be carried from hopper 70, towards feeder tube outlet 79, and into the fluidized bed in reactor chamber 4. Unlike a rigid screw feeder which masticates the particles, the bristle flights of the subject feeder bend and slip by small obstructions in the feeder tube wall, reducing torque on shaft 74 and abrasion between the brush flights 78 and the tube.

Moreover, the subject feeder means represents the only known method of continuously and uniformly introducing particles of meltable thermoplastic into an operating fluidized bed incinerator. Without the subject feeder it would not be possible to operate such a reactor continuously under substantially steady-state conditions. In accordance with this invention, additional waste particles (feedstock for the reactor) are added at a desired, controlled rate to replace those burned or hydrolyzed.

Most of the fine particulate pyrolysis and incineration products (about 10 mesh or smaller) were collected in a cyclone separator about 120 mm in diameter and 220 mm high. Referring back to FIG. 1, exhaust gases from cyclone separator 20 and very fine particulates were trapped in a conventional spray condenser 22. The condenser column 23 is 152 cm long and 15 cm in diameter. Water from sprayer 25 washes the incoming gases. Condensation from near the bottom of column 23 is recirculated to sprayer 25 by pump 27 through heat exchanger 31.

Exhaust gas was intermittently sampled through tube 58 and analyzed by a Hewlett-Packard 5840A Reporting® gas chromatograph. The chromatograph was programmed for automatic analysis of volatile products and output of the results. The Hewlett-Packard chromatograh has two 10 ft by ⅛" columns: one 5% Dexil 300 on 60/80 mesh Chromosorb-W and one 10% dexil 300 on 80/100 mesh Chromosorb-W. Line 58 from reactor 2 and the chromatograph were heated. A vacuum was drawn on line 58 to withdraw gaseous products from the reactor to the chromatograph. Consequently, the chromatograph was able to analyze the gaseous products "on line" according to a preset operating time sequence.

The general procedure for operating the reactor described above and diagrammed in FIG. 1 is as follows. First, a suitable amount of refractory particles is charged into reaction chamber 4 to form a bed 7. These particles do not degrade at reactor operating temperatures nor do they interfere with the degradation reactions. The scrap 67 to be processed is disposed in hopper 70. All the temperature and pressure signal devices, cyclone separator 20, and spray condenser 22 are activated and ignition source glow plug 66 is turned on. The gas chromatograph system 18 is activated for on-line analysis of exhaust. Cooling water is run through feeder band jacket 80.

Thereafter, reactor 2 is heated to a temperature selected for a run by burner 6 and the six band heaters (not shown) around housing 26 are turned on.

Fluidizing gas is introduced into reactor 2 at a rate to maintain good fluidization of particle bed 7. When the bed reaches the appropriate elevated temperature, air is also introduced into the bed through fitting 8 at a rate to give an oxygen level adequate to support complete combustion of the scrap. The system is then allowed to come to equilibrium characterized by a constant temperature within the bed.

At this point, scrap material is continuously introduced into the hot fluidized bed reactor via feeder mechanism 5. Once combustion is well under way, burner 6 and the band heaters are turned off. Once the self sustaining reaction is achieved, the intensity of combustion is controlled by varying the feed rate of the scrap material and the air flow rate in the reactor. Excess heat is removed through heat exchanger 56. Reactor 2 is shut down by reversing the process set forth above.

In general, the heat liberated by a burning reaction in the fluidized bed must be greater than or at least equal to the heat lost from the system by, e.g., discharge of reaction products and radiation from the reactor. By experimentation I have determined that with adequate reactor insulation, bed temperature and air velocity therein are two variables which have significant effect on the steady-state operation of the subject fluidized bed reactors.

Figure 6:
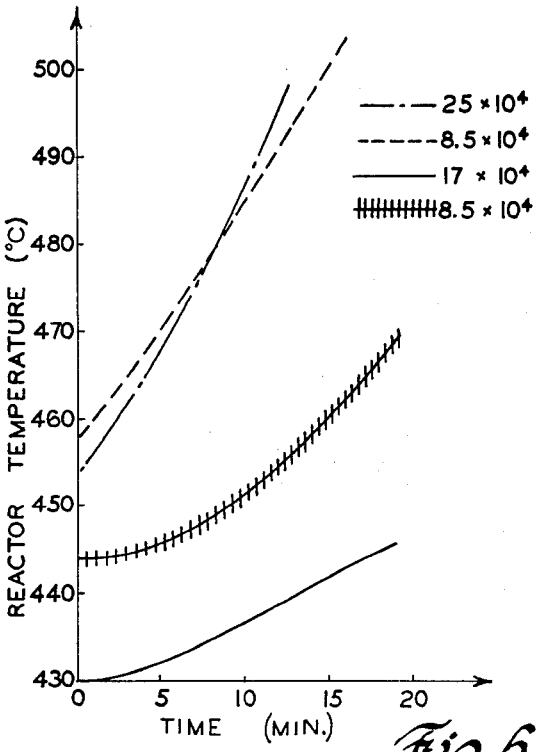
FIG. 6 is a plot of reactor temperature as a function of time for the incineration of a kilogram of acrylic paint sludge at several different fluidized air flow rates.

Referring to FIG. 6, Reactor Temperature versus Time is plotted for the incineration of one kilogram of automotive acrylic lacquer sludge at several different fluidizing air velocities. While there is considerable variation in the composition of such sludge, that used for my experiments had an approximate weight assay of about 66.5% acrylic resin based on poly(methyl methacrylate), 32 percent pigments (primarily metal oxides), 1 percent aluminum and 0.5% coagulants. The air flow rates of FIG.6 are listed adjacent corresponding line legends and are in units of $cm^3$/min Air.

Looking at the curve for an air flow rate of $17\times10^4$ $cm^3$/min at room temperature, it is clear that at too low an initial reactor temperature (here about 430° C.) that even a relatively high air flow rate will not promote a high rate of incineration of the paint sludge.

However, above a critical temperature of about 440° C., even a relatively low air flow rate will sustain burning of acrylic paint sludge. This is indicated by a significant elevation in reactor temperature with time as plotted in FIG. 6. Thus, at an air velocity of 8.5 $cm^3$/min at an initial reactor temperature of about 443° C., a sludge burning reaction is promoted and sustained.

The plot of FIG. 6 also indicates that at an initial temperature above about 450° C., reactor temperature rises relatively rapidly. This rise is about the same for air inlet flow rate of both $8.5\times10^4$ $cm^3$/min and $25\times10^4$ $cm^3$/min. This suggests that if the burning reaction within a fluidized bed reactor has a sufficient supply of oxygen and is operating above the critical ignition temperature for the feedstock, the effect of air flow rate on the reaction is not significant.

For burning one kilogram of the automotive lacquer sludge, it is clear that an initial temperature of 430° C. is somewhat low. Similarly, a starting temperature of about 445° C. does not initially promote rapid temperature rise in a reactor. However, an initial reactor temperature of about 453° C. and higher promotes rapid reactor temperature rise, indicative of efficient burning of the paint sludge. Such critical temperatures for other polymeric feedstocks can readily be determined by one skilled in the art and the fluidized bed reactor operated accordingly.

My invention is further defined in terms of the following Example.

EXAMPLE

A series of tests was conducted to investigate the self-sustaining incineration of automotive acrylic lacquer, solventborne acrylic enamel and waterborne acrylic paint. All contained about 75 weight percent poly(methyl methacrylate) with the balance being inorganic pigments and traces of other organic constituents. One kilogram of sludge predried at about 95° C. was burned per run.

The apparatus used was that described above including the fluidized bed reactor with specially adapted diffuser plate, the brush screw feeder, the exhaust treatment system, the measurement devices and all other peripheral devices. Incineration was generally carried out at one atmosphere gage pressure at a steady state reactor temperature of about 1000° C. Fluidizing air velocity through the diffuser plate was maintained at approximately 340 liters per minute. These conditions were selected to insure an adequate supply of oxygen for combustion (approximately 17% excess oxygen). The glow plug in the reactor chamber was operated continuously to assure constant ignition of the thermoplastic sludge.

More than 98.4 weight percent of the organics in the paint sludge burned at a rate of approximately 38.6 grams per minute. The sludge was introduced through the feeder tube at the same rate. The total energy released during combustion of each 2.28 kg of sludge was calculated to be approximately 13,000 kilocalories. About 0.6 kg of noncombustible solids remained in the bed material as residue. Spectrographic analysis of the residue, reported in Table I indicated that the residue consisted mostly of inorganic metal oxides. Most of the solid reaction products were removed from the exhaust gases of the reactor in the cyclone separator and spray condenser.

TABLE I

Spectrographic Analysis of Bed Residue*
Element in Each Type of Paint Sludge (%)

| Element | Acrylic Lacquer | Solventborne Enamel | Waterborne Enamel |
|---|---|---|---|
| Ti | 5 | 4 | 4 |
| Fe | 4 | 4 | 4 |
| Al | 10 | 10 | 10 |
| Si | 10 | 10 | 10 |
| Mg | 0.1 | 0.1 | 3 |
| Pb | 1 | 5 | 0.05 |
| Ni | 0.05 | 0.1 | 0.02 |
| Cu | 0.1 | 0.1 | 0.1 |
| Ca | 0.1 | 0.5 | 0.3 |
| Cr | 0.1 | 0.5 | 0.02 |
| Na | 0.1 | 0.5 | 0.1 |

*These are semi-quantitative estimates, reported in percent of sample. The actual values are expected to be within one-third to three times the reported values.

On the basis of these runs, I have found that incineration of dried paint sludge in accordance with this invention achieves the following desirable results. First, the volume of the paint sludge is reduced from about one tenth to one twentieth of its initial volume depending on initial water and pigment content of the sludge. A substantial amount of heat, approximately 6,000 kilocalories per kilogram, is generated by the combustion reaction and depending on the heat losses from the reactor, a substantial amount of this energy can be recovered for useful purposes. Moreover, the sludge undergoes almost complete oxidation of combustible components, and the noncombustible residue is relatively easy to dispose of.

The incineration of polymer scrap in a fluidized bed reactor is made possible in large part by the specially adapted feeder described and claimed herein. Now, a reliable method and means have been provided for the controlled delivery of meltable polymer scrap into a fluidized bed operating at high temperatures.

While my invention has been described in terms of specific embodiments thereof, clearly other forms may be readily adapted by one skilled in the art. Accordingly, my invention is to be limited only by the following claims.

The embodiments of the invention in which an exclusive property or privilege is claimed are defined as follows:

1. Means for feeding particles having a meltable polymer constituent into a fluidized bed reactor operating at an elevated temperature substantially above the temperature at which the particles fuse with one another, said reactor being used to thermally degrade said particles the feeder means comprising a source of said polymer particles remote from said reactor, the particles of said source being maintained at a temperature below their fusion temperature;

a feed tube having a hollow barrel portion in which said particles are transported from said source into the fluidized bed reactor;

means for flowing pressurized gas in said barrel to agitate the scrap particles therein, to maintain them at a temperature below their fusion temperature, and to prevent hot gases from the reactor from substantially penetrating the feed tube;

an auger feed within said feed tube comprising a shaft carrying a plurality of helically arrayed flexible bristles; and means for rotating said auger feed such that the scrap particles are carried by said bristles from the particle source into the fluidized reactor bed in a steady, unagglomerated stream at a desired rate.

2. A method of delivering particles having a meltable polymer constituent into a fluidized bed reactor in which the polymer is thermally degraded, the reactor operating at a temperature substantially above the polymer melting temperature but said delivery being such that the particles do not agglomerate or melt before entering the reactor, the method comprising transporting said polymer particles from a remote source thereof to the reactor through a conduit therebetween by rotating a feed auger having a helical flight of flexible bristles in the conduit, rotational motion of the feed auger causing the bristles to carry the particles toward the reactor but their flexibility preventing any substantial mastication or coalescence of the particles; flowing a gas through said conduit towards the reactor while the feed auger rotates at a rate such that the particles therein are continuously agitated and hot fluids from the fluidized bed reactor do not flow into the conduit, and at a temperature such that the particles do not melt while in the conduit; and controlling the rate of feed auger rotation to empty the unagglomerated particles from the conduit into the fluidized bed at a rate such that they are instantaneously integrated therein.

3. Means for feeding particles having a thermoplastic constituent into a fluidized bed reactor operating at an elevated temperature to thermally degrade the particles, the means comprising:

a container for holding a supply of said particles at a temperature below their melting temperature at a location remote from the reactor;

a feeder tube extending from the outlet of said container into the fluidized bed of the reactor;

cooling means surrounding said feeder tube for lowering the temperature therein below the melting temperature of the particles;

screw feeding means rotationally operative in said feeder tube for transporting said particles from the container means directly into the fluidized bed, the flight of said screw consisting of bristles spaced to carry said particles through the bore without agglomeration and being flexible enough to deflect before damaging the bore surface; and means for maintaining positive pneumatic pressure within said bore to prevent the penetration thereof by the material of the fluidized bed of the reactor and further cool the particles.

* * * * *